US006629829B1

(12) United States Patent
Shinoda et al.

(10) Patent No.: US 6,629,829 B1
(45) Date of Patent: Oct. 7, 2003

(54) VANE TYPE ROTARY MACHINE

(75) Inventors: Masao Shinoda, Fujisawa (JP); Chishiro Yamashina, Fujisawa (JP); Shimpei Miyakawa, Fujisawa (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/786,561

(22) PCT Filed: Sep. 3, 1999

(86) PCT No.: PCT/JP99/04798

§ 371 (c)(1),
(2), (4) Date: Mar. 7, 2001

(87) PCT Pub. No.: WO00/14411

PCT Pub. Date: Mar. 16, 2000

(30) Foreign Application Priority Data

Oct. 21, 1998 (JP) ..... 10-299861
Sep. 8, 1998 (JP) ..... 10-254393
Sep. 8, 1998 (JP) ..... 10-254394

(51) Int. Cl.[7] ..... F01C 1/344
(52) U.S. Cl. ..... 418/102
(58) Field of Search ..... 418/102, 235

(56) References Cited

U.S. PATENT DOCUMENTS

| | | | | | |
|---|---|---|---|---|---|
| 1,111,160 | A | * | 9/1914 | Larsen et al. | 418/235 |
| 3,272,138 | A | * | 9/1966 | Connoy et al. | 418/102 |
| 3,528,756 | A | | 9/1970 | Norling et al. | 418/102 |
| 4,265,602 | A | | 5/1981 | Teruyama | 418/102 |
| 4,355,542 | A | | 10/1982 | Tsutsumi et al. | 74/467 |
| 4,470,776 | A | | 9/1984 | Kostek et al. | 418/102 |
| 5,642,991 | A | * | 7/1997 | Singleterry et al. | 418/133 |

FOREIGN PATENT DOCUMENTS

| | | | | |
|---|---|---|---|---|
| GB | 875950 | * | 8/1961 | 418/102 |
| JP | 30-7637 | | 10/1955 | |
| JP | 47-5964 | | 3/1972 | |
| JP | 48-98405 | | 12/1973 | |
| JP | 51-16204 | | 2/1976 | |
| JP | 55-164794 | | 12/1980 | |

(List continued on next page.)

OTHER PUBLICATIONS

Handbook of Hydraulics & Pneumatics, The Japan Hydraulics & Pneumatics Society, Feb. 25, 1989, pp. 221–226.
Handbook of Hydraulics & Pneumatics, The Japan Hydraulics & Pneumatics Society, Feb. 25, 1989, pp. 267–270.
S. A. Black et al.; Proc. Natl. Conf. Fluid Power, vol. 35, pp. 111–118, 1981.
S. A. Black; Proc. Annu. Offshore Technology, 13tj 3'81, pp. 155–163, May 1981.

*Primary Examiner*—John J. Vrablik
(74) *Attorney, Agent, or Firm*—Armstrong, Westerman & Hattori, LLP

(57) ABSTRACT

The present invention relates to a vane rotary machine such as a vane pump or a vane motor. The vane rotary machine has a rotor (15) supporting vanes (60) thereon and housed in a cam casing (10), and a main shaft (40) attached to the rotor (15) and rotatably supported by a bearing assembly (200, 250). A working fluid from a discharge port (13) is branched and led to the bearing assembly (200, 250) by a fluid path (180). The main shaft (40) has a working fluid introduction recess (220) defined in a region thereof in which the bearing assembly (200, 250) is disposed, and the main shaft has a reduced diameter in the working fluid introduction recess. The working fluid is introduced into the working fluid introduction recess (220).

2 Claims, 17 Drawing Sheets

U.S. PATENT DOCUMENTS

| | | | | |
|---|---|---|---|---|
| JP | 57-76285 | | 5/1982 | |
| JP | 59-115484 | | 7/1984 | |
| JP | 59-168291 | | 9/1984 | |
| JP | 61-81591 | * | 4/1986 | ..... 418/235 |
| JP | 62-6308 | | 2/1987 | |
| JP | 63-272991 | | 11/1988 | |
| JP | 64-69787 | * | 3/1989 | ..... 418/97 |
| JP | 1-167488 | | 7/1989 | |
| JP | 1-162093 | | 11/1989 | |
| JP | 2-275086 | | 11/1990 | |
| JP | 4-43880 | | 2/1992 | |
| JP | 4-51677 | | 8/1992 | |
| JP | 4-325786 | | 11/1992 | |
| JP | 5-47489 | | 6/1993 | |
| JP | 5-78991 | | 10/1993 | |
| JP | 6-159259 | | 6/1994 | |
| JP | 7-38685 | | 7/1995 | |
| JP | 7-293467 | | 11/1995 | |
| JP | 7-310675 | | 11/1995 | |
| JP | 8-261184 | | 10/1996 | |
| JP | 2528013 | | 12/1996 | |
| JP | 9-144668 | | 6/1997 | |
| JP | 9-264292 | | 10/1997 | |
| JP | 10-68390 | | 3/1998 | |
| JP | 10-122160 | | 5/1998 | |

* cited by examiner

VANE TYPE ROTARY MACHINE

TECHNICAL FIELD

The present invention relates to a vane rotary machine such as a vane pump or a vane motor, and more particularly to a vane rotary machine suitable for use in applications where a low-viscosity fluid such as water is used as a working fluid.

BACKGROUND ART

FIGS. 15A and 15B are views showing an example of a structure of a conventional typical vane pump (unbalanced type). FIG. 15A is a cross-sectional view taken along line 15A—15A of FIG. 15B, and FIG. 15B is a cross-sectional view taken along line 15B—15B of FIG. 15A.

As shown in FIGS. 15A and 15B, the vane pump comprises a rotor 85 housed in a cam casing 80, a plurality of vanes 120 mounted on the rotor 85 and held in contact with an inner surface of the cam casing 80, a front cover 90 and an end cover 95 surrounding opposite sides of the rotor 85, a main shaft 110 attached to the rotor 85 and rotatably supported by bearings 100, 105 such as ball bearings mounted in the front cover 90 and the end cover 95, a rear cap 115 mounted on the end cover 95, and a seal (shaft seal) 113 mounted on the front cover 90. When the rotor 85 is rotated, a fluid drawn from a supply port 81 defined in the cam casing 80 into a space between adjacent ones of the vanes 120 is pumped and discharged into a discharge port 83.

FIG. 16 is a vertical cross-sectional view showing an example of a structure of a conventional typical floating side plate type vane pump. Those parts of the vane pump in FIG. 16 which are identical to those shown in FIGS. 15A and 15B are denoted by identical reference numerals. In order to reduce the flow rate of fluid leaking from gaps between the side surfaces of the rotor 85 and the front and end covers 90, 95 of the vane pump shown in FIGS. 15A and 15B, the floating side plate type vane pump has pressure side plates 125, 130 disposed respectively between the rotor 85 and the front cover 90 and between the rotor 85 and the end cover 95 and pressed against the both side surfaces of the rotor 85 by resilient means 127, 131 such as compression coil springs, with the pressure of the discharged fluid being applied to the rear surfaces of the pressure side plates 125, 130 by fluid paths 137, 139 connected to the discharge port 135.

Depending on the discharged pressure of the pump that is applied to the rear surfaces of the pressure side plates 125, 130, the force by which the pressure side plates 125, 130 are pressed against the side surfaces of the rotor 85 is changed to adjust the rotor side clearances for thereby reducing the flow rate of fluid leaking from rotor side clearances. If a low-viscosity fluid such as water is used as the working fluid, the leakage from the rotor side clearances may possibly be large, and hence the floating side plate type vane pump can preferably be used as it can reduce the flow rate of leakage fluid.

If the structure shown in FIG. 16 is used as a floating side plate type vane motor, then the port 135 may be used as a high-pressure supply port, and the pressure of the working fluid may be applied to the rear surfaces of the pressure side plates 125, 130 by the port 135.

The vane motor is of a structure which is essentially identical to the structure of the vane pump. In the vane pump, the vanes are pressed against the inner surface of the cam casing under centrifugal forces and the pressure of the working fluid. In the vane motor, until the vanes are pushed out under centrifugal forces in a stage where the motor starts rotating, the fluid passes through from the higher-pressure side to the lower-pressure side. Therefore, the vane motor has resilient means for pushing the vanes against the inner surface of the cam casing from the start of operation thereof. While the illustrated structures are of the unbalanced type, balanced-type vane pump and motor also operate substantially in the same manner as the illustrated structures.

In each of the above conventional structures, the main shaft 110 is rotatably supported by the bearings 100, 105 such as ball bearings. The bearings 100, 105 usually comprise rolling bearings (ball bearings) in the ordinary case (hydraulic pressure, pneumatic pressure).

The unbalanced vane pump (or motor) suffers the problem of an increased radial load. Particularly, if a low-viscosity fluid such as water is used as the working fluid, then the bearing assembly is liable to be subject to seizure due to a lubrication shortage, and the balls, retainers, or inner and outer races of the bearing assembly are liable to be damaged.

One solution to the above drawbacks is to use sliding bearings 100A, 105A (also applicable to the conventional structure shown in FIG. 16) as shown in FIG. 17. However, the solution also suffers the following problems:

For lubricating the sliding bearings, the working fluid is interposed as a lubricating medium between the sliding surfaces of the main shaft 110 and the sliding bearings 100A, 105A. If a low-viscosity fluid such as water (tap water) is used as the working fluid, then because of its low viscosity, a mechanical loss due to the friction in the bearing assembly (the bearings 100A, 105A and the main shaft 110) tends to be large. It is complex and difficult to select materials of the bearings 100A, 105A and the main shaft 110 for eliminating such a drawback. Depending on the selection of those materials, the mechanical loss may be increased, and there is a possibility that the mechanical efficiency is lowered. In addition, the main shaft 110, the bearings 100A, 105A, or other parts may possibly be damaged due to the heat generated between the main shaft 110 and the bearings 100A, 105A.

With the bearings 100A, 105A being arranged as shown in FIG. 17, liquid reservoirs R are formed as shown in the drawing. If water (tap water) is used as the working fluid, then crevice corrosion is caused in the liquid reservoirs R and the water as the working fluid itself is corroded and degraded, thus causing scales to be clogged in small spaces in the device, and thus suffering a failure or lowering durability.

FIG. 18 is an enlarged cross-sectional view of the seal 113 shown in FIG. 15B. In the vane rotary machine of the type described above, the seal (shaft seal) 113 is used. Depending on the kind of the seal 113, it is preferable that an internal seal pressure P be as small as possible in most cases. If the internal seal pressure P is large, then the seal 113 is pressed against the main shaft 110 under a large force to thus generate a mechanical loss due to the friction in this region. In addition, the seal 113 and the main shaft-110 are frictionally worn, and there is a possibility that their durability is lowered.

In order to suppress the increase in the internal seal pressure P, as shown in FIG. 19, it is conceivable to provide a fluid path 150 defined between the bearing 100 and the seal 113 and communicating with a low-pressure supply port (not shown in FIG. 19, but see the supply port 81 shown in FIG. 15A).

If a low-viscosity fluid such as water is used as the working fluid in a rotary machine of the above structure, then a mechanical loss due to the friction between the vanes 120 and rotary slits 87, between the rotor 85 and the front cover 90, and between the rotor 85 and the end cover 95 is possibly increased. In order to reduce such a mechanical loss, it has been proposed that the vanes 120 and the rotor 85 are made of ceramics having good slidability in water lubrication or various engineering plastics such as PEEK (polyetheretherketone) or PTFE (polytetrafluoroethylene). It is important that the rotor 85, in particular, be made of the above materials. In the vane rotary machine, the rotor 85 is displaceable axially of the main shaft 110 in a range of side clearances of the rotor 85, i.e., the gaps between the rotor 85 and the front cover 90 and between the rotor 85 and the end cover 95.

However, the fluid path 150 provided for suppressing the internal seal pressure P as shown in FIG. 19 brings the pressures on the both side surfaces of the rotor 85 out of balance with each other. Specifically, in FIG. 19, the pressure P1 of a portion around the bearing 100 that communicates with the low-pressure supply port via the fluid path 150 is $P1 \approx 0$, and the pressure P2 of a portion around the bearing 105 which is not connected to the fluid path 150 is $P2 \neq 0$. Since $P1 < P2$ and these pressures P1, P2 are applied respectively to the both side surfaces of the rotor 85, the rotor 85 is pressed against the front cover 90 because of the unbalanced state between the pressures on the both side surfaces of the rotor 85. Therefore, the frictional loss of the contact surface against which the rotor 85 is pressed tends to be increased. As a result, the mechanical efficiency is lowered, and the output is reduced. Owing to the wear of the rotor 85, the flow rate of leakage fluid is increased, the volumetric efficiency is lowered, and the durability is reduced.

In the conventional structures shown in FIGS. 15A, 15B, and 16, as shown in FIG. 20, each vane 120 is moved (slid) in a reciprocating manner in the rotor slit 87 defined in the rotor 85. If a low-viscosity fluid such as water is used as the working fluid, then the frictional resistance due to the sliding movement increases between the vane 120 and the inner surfaces of the rotor slit 87, and the parts suffer an increased wear and an increased mechanical loss. Thus, the pump or motor has its mechanical efficiency and durability lowered.

Normally, the gap (clearance) between the vane 120 and the rotor slit 87 of the hydraulic vane pump and vane motor is in the range of 30 to 50 $\mu$m. If a low-viscosity fluid such as water is used, then the leakage of the fluid from the gap increases due to the nature of the low-viscosity fluid, resulting in an increased flow loss which causes a reduction in the volumetric efficiency of the pump and motor.

Such a difficulty may be avoided by reducing the gap or eliminating the gap. If the gap is reduced or eliminated, then the frictional resistance due to the sliding motion between the vanes 120 and the rotor slits 87 is increased, thus increasing the mechanical loss. The parts are greatly worn, and suffer a durability problem.

In addition to the above problems, if the floating side plate type vane pump and vane motor shown in FIG. 16 uses a low-viscosity fluid such as water as the working fluid, then a large frictional resistance due to the sliding motion is produced between the rotor 85 and the pressure side plates 125, 130 due to the nature of the working fluid. The large frictional resistance is liable to increase the mechanical loss, and the parts are liable to suffer wear and seizure which reduce the durability of the pump and motor.

Furthermore, since the rotor slits 87 are directly machined in the rotor 85, as shown in FIG. 20, the rotor slits 87 are formed inefficiently, and it is difficult to manage the clearances between the rotor slits 87 and the vanes 120.

DISCLOSURE OF INVENTION

The present invention has been made in view of the above shortcomings. It is a first object of the present invention to provide a vane rotary machine which has a bearing assembly, for supporting the main shaft of a rotor, whose performance is not deteriorated even if a low-viscosity fluid such as water is used as the working fluid, and which can prevent its efficiency from being lowered and has increased durability.

A second object of the present invention is to provide a vane rotary machine which can prevent its efficiency and durability from being lowered even if a low-viscosity fluid such as water is used as the working fluid, has rotary slits having a good workability, and allows clearances between rotary slits and vanes to be managed with ease.

In order to achieve the first object, according to the present invention, there is provided a vane rotary machine having a rotor supporting vanes thereon and housed in a cam casing, and a main shaft attached to the rotor and rotatably supported by a bearing assembly, characterized in that a fluid path is provided for branching a working fluid from a high-pressure one of ports of the vane rotary machine and leading the working fluid to the bearing assembly.

It is preferable that the main shaft has a working fluid introduction recess formed by reducing a diameter of the main shaft in a region in which the bearing assembly is disposed, and the working fluid is introduced into the working fluid introduction recess.

According to the present invention, there is also provided a vane rotary machine having a rotor supporting vanes thereon and housed in a cam casing, and a main shaft attached to the rotor and rotatably supported by a bearing assembly, characterized in that the bearing assembly comprises a sliding bearing, and a fluid path is provided for connecting either one of ports of the vane rotary machine to the bearing assembly for thereby allowing the working fluid to pass through a portion of the bearing assembly.

It is preferable that the fluid path is provided for connecting a low-pressure one of the ports of the vane rotary machine to the bearing assembly for thereby leading the working fluid from a high-pressure one of the ports of the vane rotary machine via a side clearance of the rotor and thereafter through the bearing assembly to the low-pressure port of the vane rotary machine.

According to the present invention, there is also provided a vane rotary machine having a rotor supporting vanes thereon and housed in a cam casing, a pressure side plate which is pressed against a side of the rotor depending on a pressure used, and a main shaft attached to the rotor and rotatably supported by a bearing assembly, characterized in that the bearing assembly comprises a hydrostatic bearing, and a fluid path is provided for branching a working fluid from a high-pressure one of ports of the vane rotary machine and leading the working fluid to the bearing assembly.

It is preferable that the fluid path is provided for branching the working fluid from the high-pressure port of the vane rotary machine and supplying the working fluid to the bearing assembly and the pressure side plate.

It is preferable that the fluid path is provided for branching the working fluid from the high-pressure port of the vane rotary machine, allowing the working fluid to pass through the bearing assembly, and thereafter leading the working fluid to the pressure side plate.

According to the present invention, there is also provided a vane rotary machine having a rotor supporting vanes thereon and housed in a cam casing, and a main shaft attached to the rotor and rotatably supported by bearing assemblies, characterized in that fluid paths are provided for leading a fluid under pressure from the bearing assemblies disposed on both sides of the rotor to respective low-pressure ports.

In order to achieve the second object, according to the present invention, there is provided a vane rotary machine having a rotor supporting vanes thereon and housed in a cam casing, characterized in that the rotor has rotor slit members mounted therein and having rotor slits, and the rotor slit members are made of a low-frictional-wear material and house the vanes therein. The low-frictional-wear material is a material which is worn to a low level by friction.

It is preferable that the rotor slit members are made of plastics or ceramics.

According to the present invention, there is also provided a vane rotary machine having a rotor supporting vanes thereon and housed in a cam casing, and a pressure side plate which is pressed against a side of the rotor depending on a pressure used, characterized in that the pressure side plate has a surface which is pressed against the side of the rotor, and at least the surface is made of a low-frictional-wear material.

It is preferable that the pressure side plate is made of plastics or ceramics, or has a surface coated with plastics, ceramics, titanium nitride, or diamond-like carbon.

According to the present invention, there is also provided a vane rotary machine having a rotor supporting vanes thereon and housed in a cam casing, and a pressure side plate which is pressed against a side of the rotor depending on a pressure used, characterized in that the pressure side plate has a fluid path defined therein for forming a water film between the pressure side plate and the rotor.

BEST MODE FOR CARRYING OUT THE INVENTION

Embodiments of the present invention will be described below in detail with reference to the drawings.

First Embodiment

Figure 1:
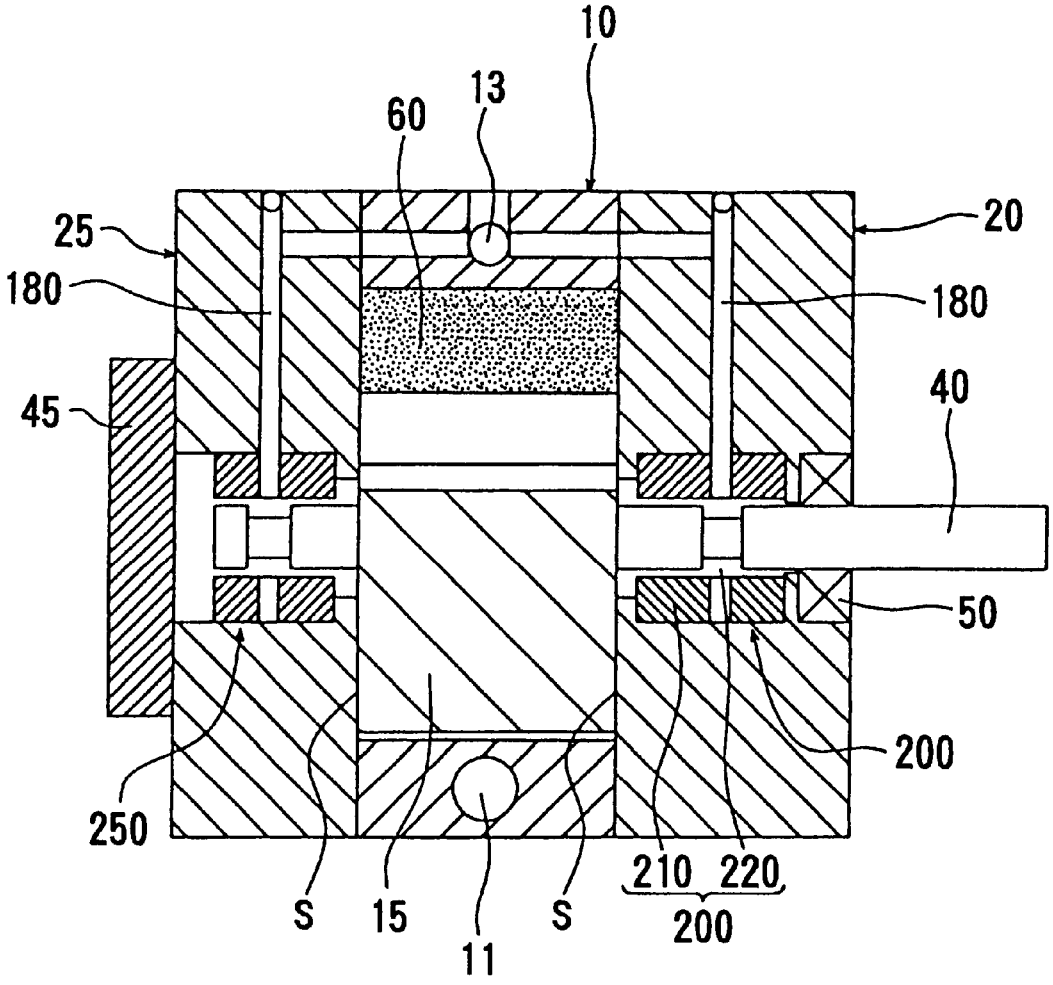
FIG. 1 is a vertical cross-sectional view of a vane pump according to a first embodiment of the present invention.

FIG. 1 is a vertical cross-sectional view of a vane rotary machine constructed as a vane pump according to a first embodiment of the present invention.

As shown in FIG. 1, the vane pump comprises a rotor 15 housed in a cylindrical cam casing 10, a plurality of vanes 60 mounted on the rotor 15 and held in contact with an inner surface of the cam casing 10, a front cover 20 and an end cover 25 surrounding opposite sides of the rotor 15, a main shaft 40 attached to the rotor 15 and rotatably supported by bearing assemblies 200, 250 mounted in the front cover 20 and the end cover 25, a rear cap 45 mounted on the end cover 25, and a seal 50 mounted on the front cover 20. When the main shaft 40 is driven to rotate the rotor 15, a fluid drawn from a supply port (supply side) 11 defined in the cam casing 10 into a space between adjacent ones of the vanes 60 is pumped and discharged into a discharge port (discharge side) 13.

Figure 2:
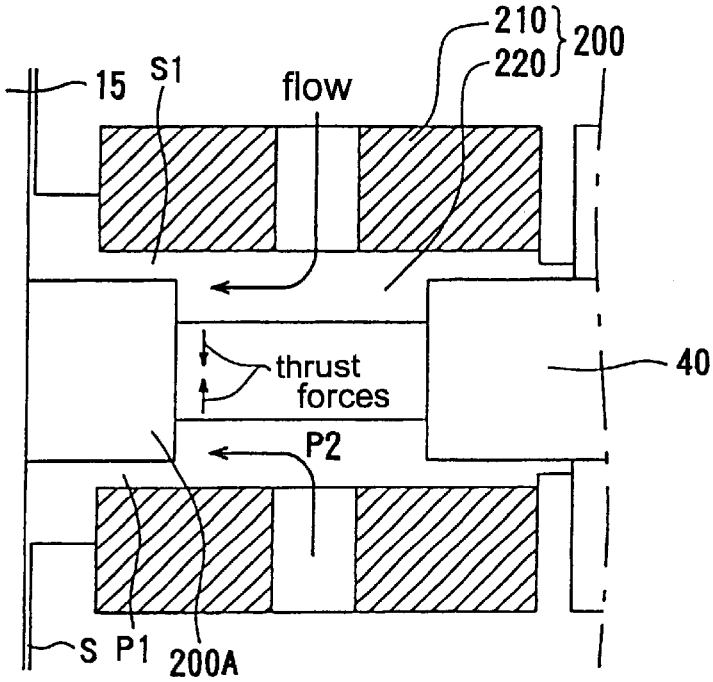
FIG. 2 is an enlarged fragmentary view of a bearing assembly 200.

FIG. 2 is an enlarged fragmentary view of the bearing assembly 200. As shown in FIG. 1, a working fluid is led from the discharge port 13 via fluid paths 180 to the bearing assemblies 200, 250. The bearing assembly 200 comprises a cylindrical bearing 210 fixed to the front cover 20, and a working fluid introduction recess 220 defined in the main shaft 40 which extends through the cylindrical bearing 210. The working fluid introduction recess 220 is formed in the main shaft 40 by reducing the diameter of the main shaft 40. The bearing assembly 250 has an identical structure.

When the vane pump is driven, the working fluid is branched from the discharge port 13, which is a high-pressure side, via the fluid path 180 into the working fluid introduction recess 220. Then, the working fluid flows from the working fluid introduction recess 220 via a gap S1 between the main shaft 40 of the rotor 15 and the bearing 210 and side clearances (gaps between the rotor 15 and the front cover 20 and between the rotor 15 and the end cover 25) S of the rotor 15 into a low-pressure side (the supply port 11).

The pressures in the working fluid introduction recess 220 are related to each other as P2>P1 (see FIG. 2). At this time, as shown in FIG. 2, radial thrust forces are produced on the main shaft 40 to levitate and support the main shaft 40 out of contact with other members, allowing the main shaft 40 to be centered automatically.

The above action is also performed by the bearing assembly 250. If the vane rotary machine is used as a vane motor, the port 13 operates as a high-pressure supply port, and the port 11 operates as a low-pressure return port. In brief, the vane rotary machine may be arranged such that the working fluid from the high-pressure port is branched and led to the bearing assemblies 200, 250.

Figure 3:
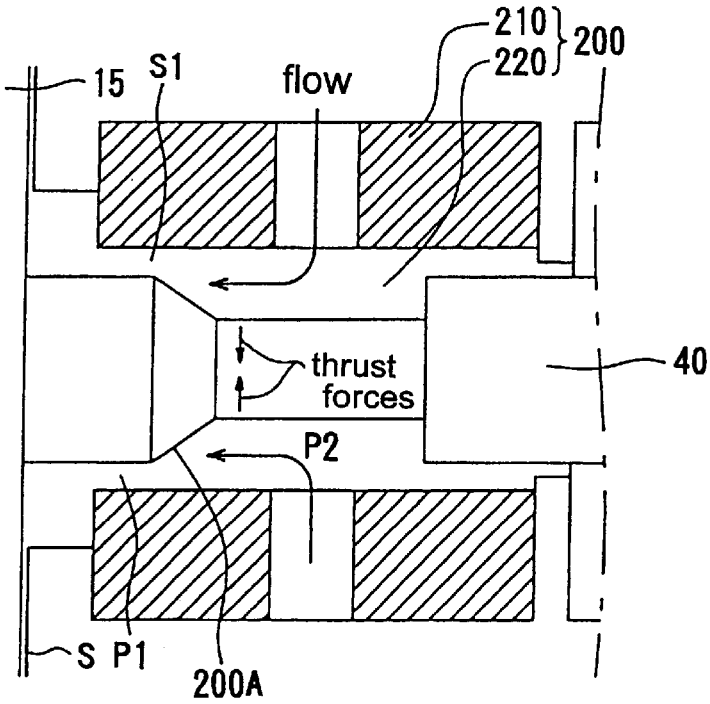
FIG. 3 is an enlarged fragmentary view of another example of the bearing assembly 200.

FIG. 3 is an enlarged fragmentary view of another example of the bearing assembly. In the example shown in FIG. 3, a step 200A on the main shaft 40 is of a tapered shape. The tapered step 200A offers the same advantages as those described above.

Since the working fluid is led to the bearing assemblies, as described above, the bearing assemblies are prevented from being deteriorated and have increased durability even if a low-viscosity fluid such as water is used as the working fluid.

Second Embodiment

Figure 4:
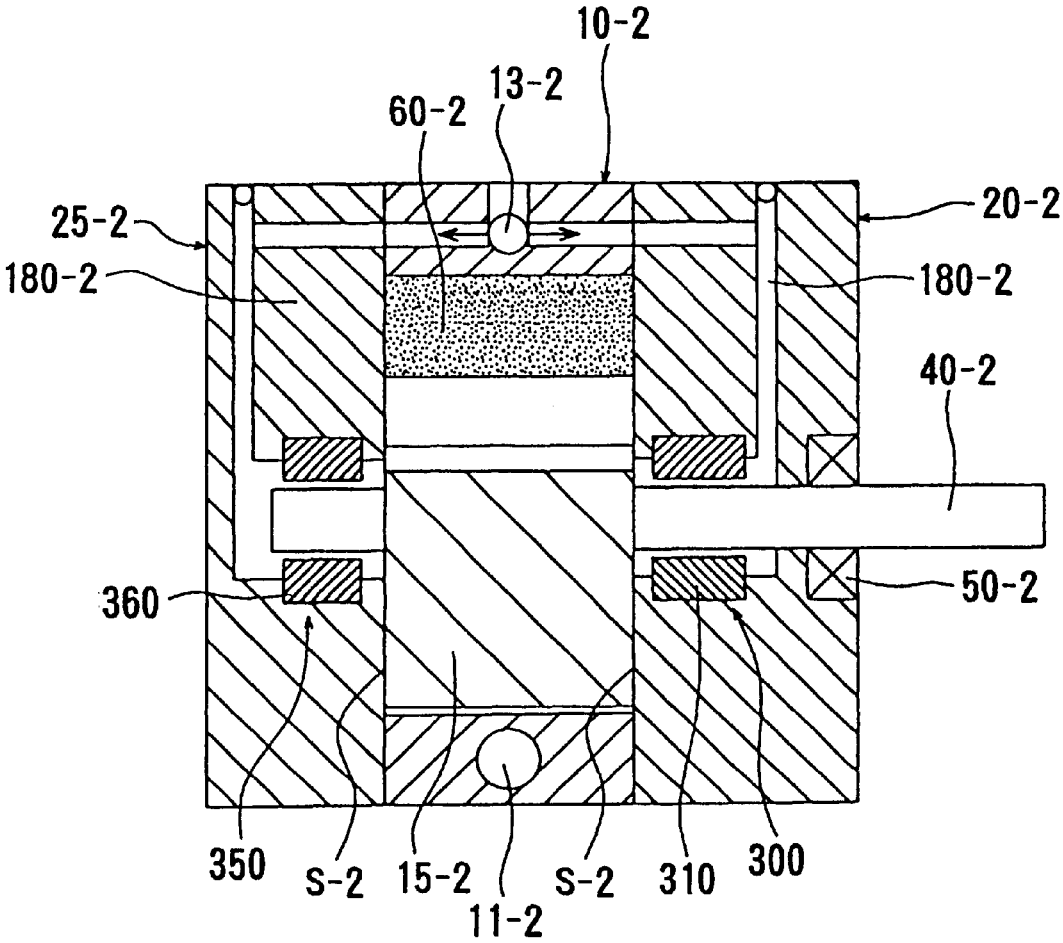
FIG. 4 is a vertical cross-sectional view of a vane pump according to a second embodiment of the present invention.

FIG. 4 is a vertical cross-sectional view of a vane rotary machine constructed as a vane pump according to a second embodiment of the present invention.

As shown in FIG. 4, the vane pump comprises a rotor 15-2 housed in a cam casing 10-2, a front cover 20-2 and an end cover 25-2 surrounding opposite sides of the rotor 15-2, a main shaft 40-2 attached to the rotor 15-2 and rotatably supported by bearing assemblies 300, 350 mounted in the front cover 20-2 and the end cover 25-2, and a seal 50-2 mounted on the front cover 20-2. When the rotor 15-2 is rotated, a fluid drawn from a supply port 11-2 into a space between adjacent vanes 60-2 is pumped and discharged into a discharge port 13-2.

In this embodiment, the bearing assemblies 300, 350 comprise sliding bearings, and the working fluid is led from the discharge port 13-2 via fluid paths 180-2 to the bearing assemblies 300, 350.

The bearing assemblies 300, 350 comprise cylindrical sliding bearings 310, 360 made of ceramics, or stainless steel coated with a plastic (resin) material such as fluororesin (PTFE) or polyetheretherketone (PEEK), or ceramics, titanium nitride (TiN), diamond-like carbon (DLC), or the like, which is of excellent slidability (low-frictional-wear property) when lubricated by water (and a low-viscosity fluid). The cylindrical sliding bearings 310, 360 are press-fitted, shrink-fitted, or bonded to the front cover 20-2 and the end cover 25-2.

The fluid paths 180-2 are connected to the sides of the bearing assemblies 300, 350 remote from the rotor 15-2, so that the working fluid is led via the gaps between the bearings 310, 360 and the main shaft 40-2 to the both side surfaces of the rotor 15-2.

When the vane pump is driven, the working fluid is branched from the discharge port 13-2, which is a high-pressure side, via the fluid paths 180-2, passes between the bearing assemblies 300, 350 and the main shaft 40-2, and thereafter returns via side clearances (gaps between the both ends of the rotor 15-2 and the front and end covers 202, 25-2) S-2 of the rotor 15-2 to a low-pressure side (the supply port 11-2).

Figure 17:
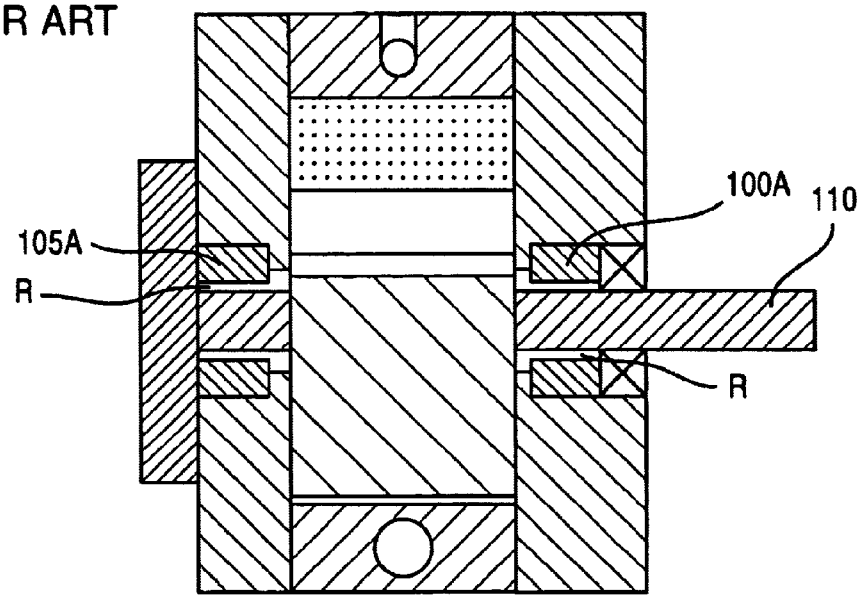
FIG. 17 PRIOR ART
FIG. 17 is a vertical cross-sectional view showing an example of a structure of another conventional vane pump.
Figure 18:
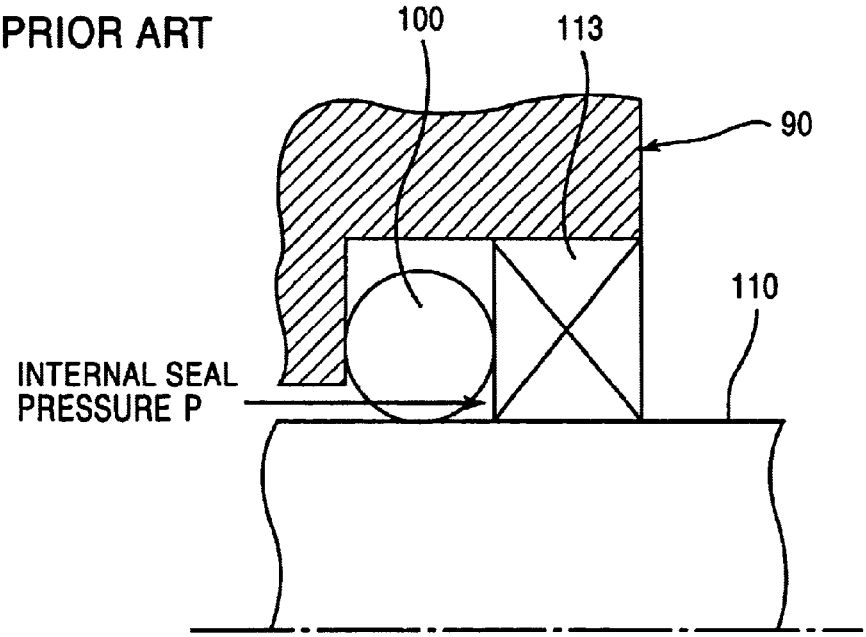
FIG. 18 PRIOR ART
FIG. 18 an enlarged cross-sectional view of a seal 113 in FIG. 15.
Figure 19:
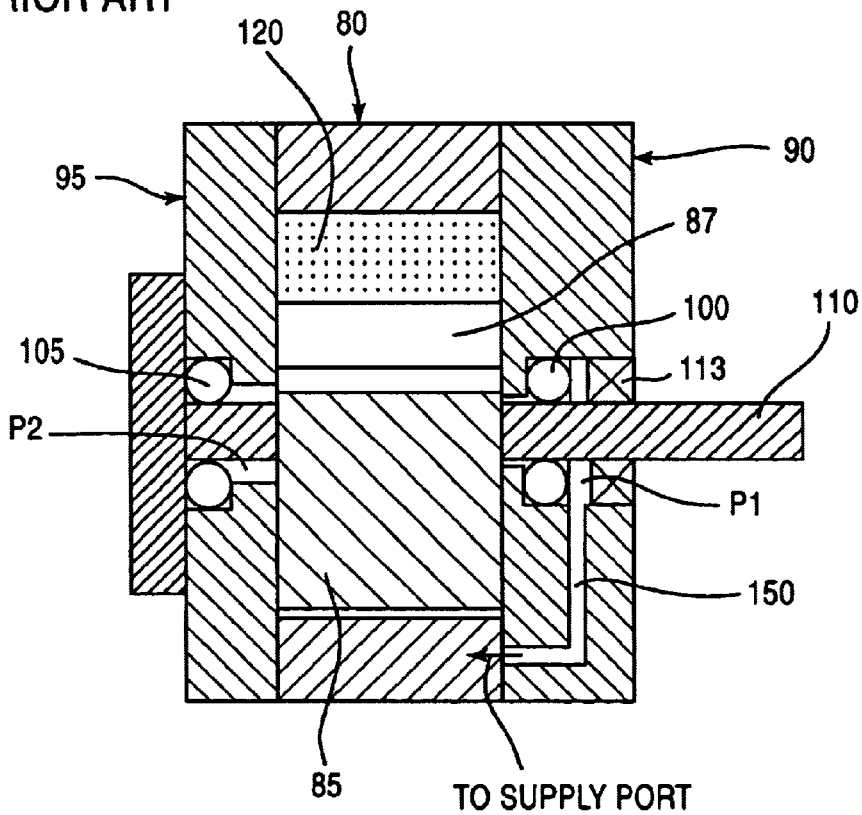
FIG. 19 PRIOR ART
FIG. 19 is a vertical cross-sectional view of a vane pump as a reference example.
Figure 20:
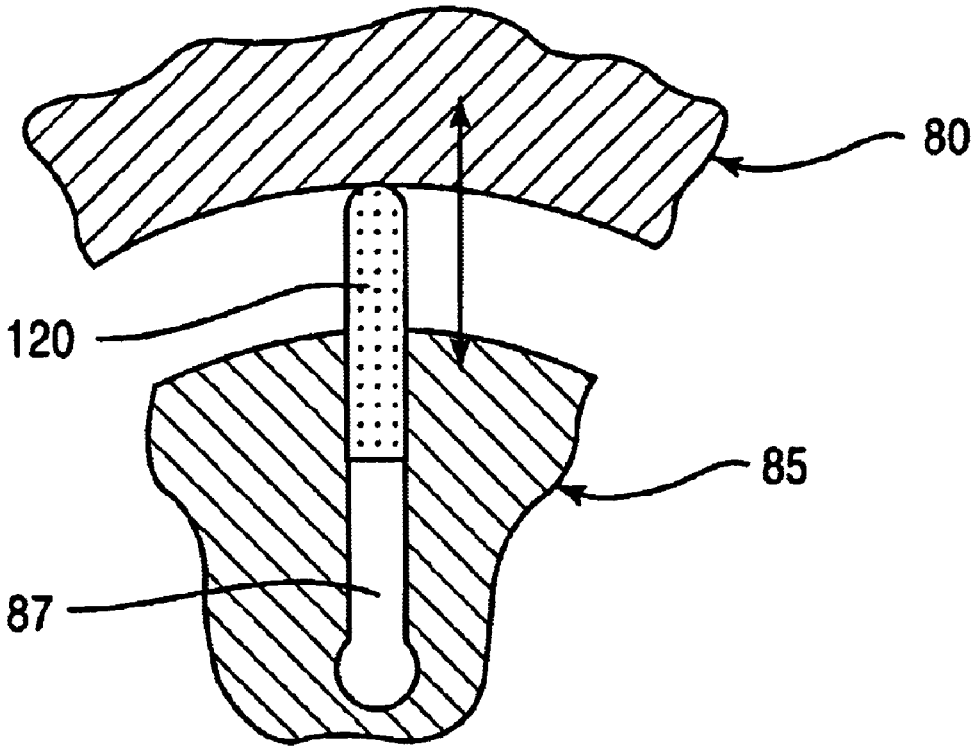
FIG. 20 PRIOR ART
FIG. 20 is an enlarged fragmentary cross-sectional view of a conventional vane 120.

In this embodiment, the vane pump does not have the liquid reservoirs R in the conventional sliding bearings 10A, 105A shown in FIG. 17, and the working fluid circulates in the device at all times. Therefore, the crevice corrosion is prevented and the water as the working fluid itself is prevented from being corroded and degraded. In addition, since the heat generated by the friction between the main shaft 40-2 and the bearings 310, 360 in the bearing assemblies 300, 350 is removed by the working fluid, the generated heat is prevented from increasing.

Figure 5:
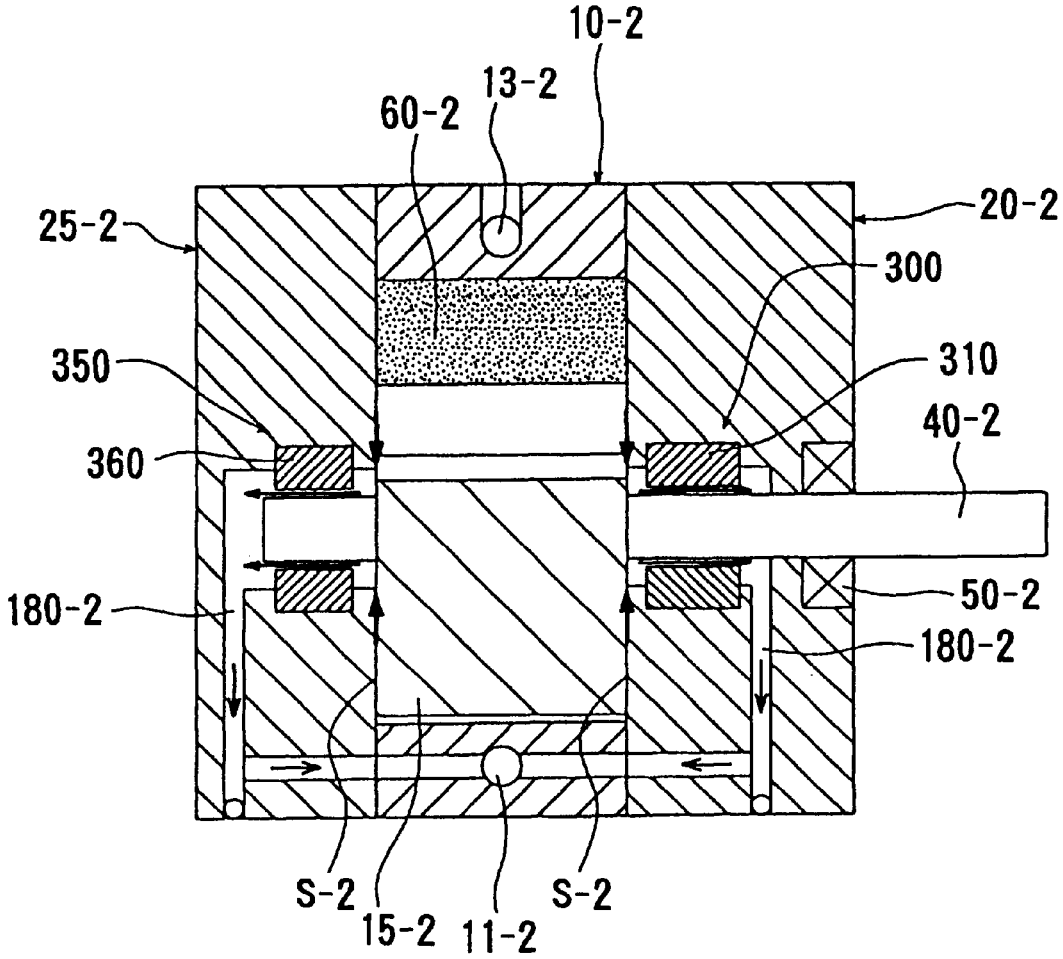
FIG. 5 is a vertical cross-sectional view of a vane pump according to a modification of the second embodiment of the present invention.

FIG. 5 is a vertical cross-sectional view of a vane rotary machine constructed as a vane pump according to a modification of the second embodiment of the present invention. Those parts of the modification which are identical or correspond to those of the second embodiment are denoted by identical reference numerals.

The vane pump is different from the vane pump shown in FIG. 4 only with respect to the fluid paths 180-2. With the structure of the vane pump shown in FIG. 4, the high-pressure working fluid is led to the bearings 300, 350 at all times, and flows via the side clearances S-2 of the rotor 15-2 to the low-pressure side. In the vane pump shown in FIG. 5, however, the fluid paths 180-2 are arranged to connect the bearing assemblies 300, 350 and the supply port 11-2 to each other.

With this arrangement, the working fluid that has passed from the high-pressure side via the side clearances S-2 of the rotor 15-2 to the bearing assemblies 300, 350 passes through the gaps between the bearings 310, 360 and the main shaft 40-2, and thereafter is led to the supply port 11-2.

With the structure according to the embodiment shown in FIG. 4, worn particles of the bearing assemblies 300, 350 pass through the side clearances S-2 of the rotor 15-2, and tend to clog the side clearances S-2, possibly causing the vane pump to fail to operate. With the vane pump shown in FIG. 5, however, because the working fluid which has passed through the bearing assemblies 300, 350 flows to the low-pressure side (the supply port 11-2), the vane pump does not present the above problem.

The vane rotary machine can be used as a vane motor as with the first embodiment.

Since the working fluid is led to the bearing assemblies, as described above, the bearing assemblies are prevented from being deteriorated, the generated heat is prevented from increasing, and the working fluid is prevented from being corroded and degraded even if a low-viscosity fluid such as water is used as the working fluid.

Third Embodiment

Figure 6:
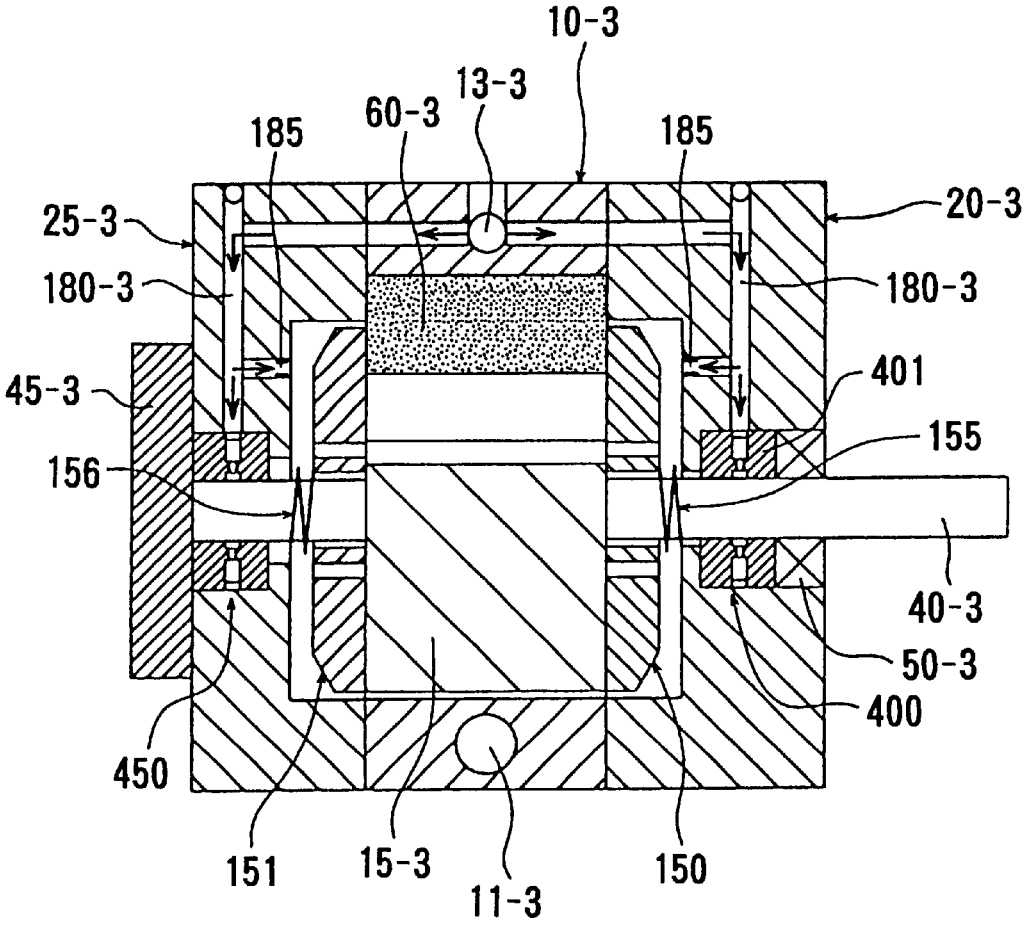
FIG. 6 is a vertical cross-sectional view of a floating side plate type vane pump according to a third embodiment of the present invention.

FIG. 6 is a vertical cross-sectional view of a vane rotary machine constructed as a floating side plate type vane pump according to a third embodiment of the present invention.

As shown in FIG. 6, the floating side plate type vane pump comprises a rotor 15-3 housed in a cam casing 10-3 and supporting vanes 60-3, a front cover 20-3 and an end cover 25-3 surrounding opposite sides of the rotor 15-3, pressure side plates 150, 151 which are disposed between the rotor 15-3 and the front and end covers 20-3, 25-3 for reducing the flow rate of fluid leaking from gaps between the both side surfaces of the rotor 15-3 and the front and end covers 20-3, 25-3 and pressed against the both side surfaces of the rotor 15-3 by resilient means 155, 156 such as compression coil springs, a main shaft 40-3 attached to the rotor 15-3 and rotatably supported by bearing assemblies 400, 450 mounted in the front cover 20-3 and the end cover 25-3, a rear cap 45-3 mounted on the end cover 25-3, and a seal 50-3 mounted on the front cover 20-3. When the rotor 15-3 is rotated, a fluid drawn from a supply port 11-3 into a space between adjacent ones of the vanes 60-3 is pumped and discharged into a discharge port 13-3.

Figure 7:
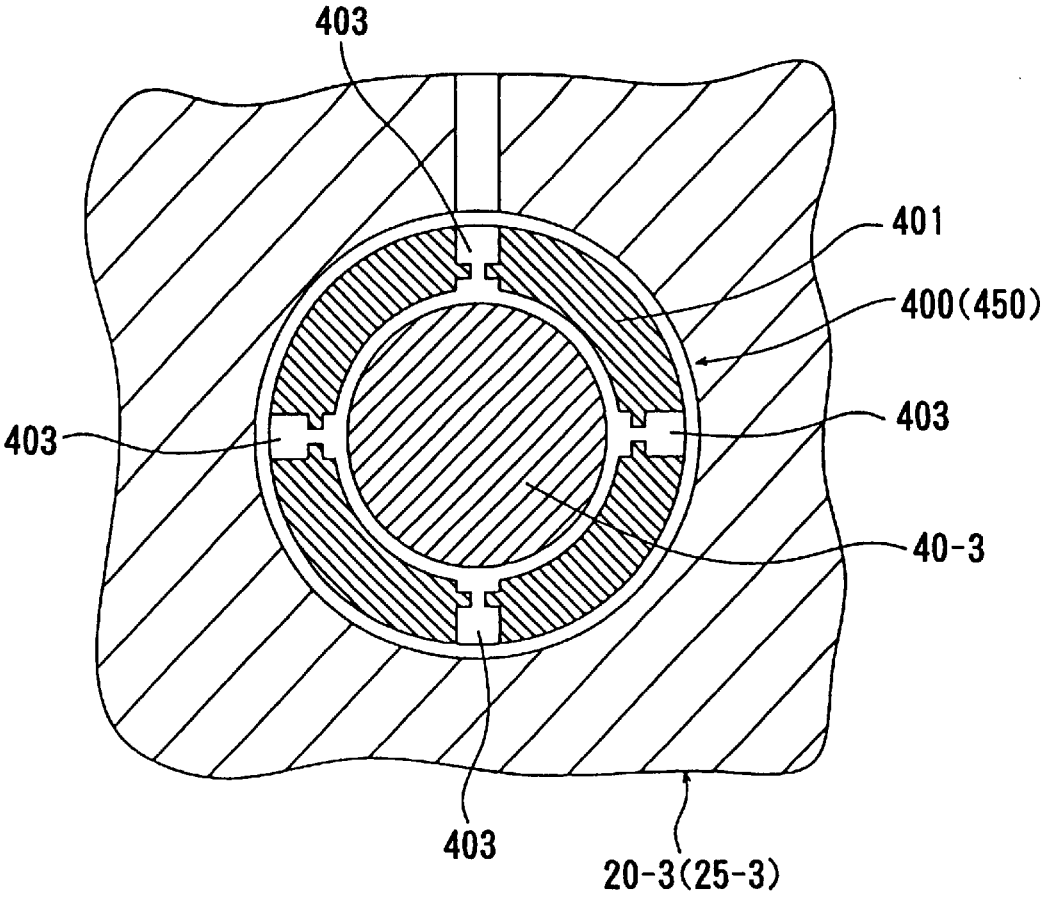
FIG. 7 is a fragmentary cross-sectional view of a bearing assembly 400 (450) shown in FIG. 6.

According to this embodiment, the bearing assemblies 400, 450 comprise hydrostatic bearings. Specifically, as shown in detail in FIG. 7, a cylindrical bearing member 401 has four restriction holes 403 defined therein which are supplied with the working fluid to support a radial load to levitate and support the main shaft 40-3 rotatably out of contact with other members. The bearing assembly 450 also has an identical structure. The working fluid is supplied via fluid paths 180-3 branched from the discharge port 13-3 to the outer circumferences of the bearing assemblies 400, 450.

The main shaft 40-3 and the bearing member 401 operate out of contact with each other by the hydrostatic bearings. Therefore, the bearing assemblies 400, 450 are prevented from being deteriorated and producing increased heat. Inasmuch as the bearings are kept out of contact with the main shaft unlike the sliding bearings, the members of the bearing assemblies may be made of a material that can be selected with ease. The condition for selecting the material may be such that the material should be resistant to corrosion by a fluid as the working fluid. If water is used as the working fluid, for example, then stainless steel is selected.

The number and positions of the bearing assemblies 400, 450 are selected depending on the specifications of the pump (motor) and the operating conditions.

In this embodiment, the fluid paths 180-3 are branched to supply part of the working fluid to the rear surfaces of the pressure side plates 150, 151. The fluid paths 180-3 that are branched toward the pressure side plates 150, 151 have restrictions 185, 185. These restrictions 185, 185 serve to easily lead the high-pressure working fluid to the bearing assemblies 400, 450. By selecting the diameters of the restrictions 185, 185, it is possible to change, as desired, the load capacity of the bearing assemblies 400, 450 and the forces by which the pressure side plates 150, 151 are pressed against the rotor 15-3.

In the present embodiment, the working fluid is supplied partly to the bearing assemblies 400, 450 and also to the pressure side plates 150, 151. Consequently, while the advantages of the floating side plate type vane pump are being utilized, the bearings 400, 450 can support a radial load. If a low-viscosity fluid such as water is used as the working fluid, any mechanical loss of the bearing assemblies 400, 450 can be reduced, and the flow rate of fluid leaking from the side clearances of the rotor 15-3 can also be reduced.

The pressure side plates 150, 151 are made of a low-frictional-wear material which is of excellent slidability (low-frictional-wear property) when lubricated by water, e.g., plastics, ceramics, or such a material to which a coating is applied.

If the vane rotary machine is used as a vane motor, the working fluid is supplied such that the port 13-3 operates as a high-pressure supply port. In brief, the vane rotary machine may be arranged such that the working fluid from the high-pressure port is branched to the bearing assemblies 400, 450.

In the present embodiment, the pressure side plates 150, 151 are disposed respectively on the both sides of the rotor 15-3. Depending on the structure of the vane rotary machine, a pressure side plate may be disposed on only one side of the rotor 15-3.

Figure 8:
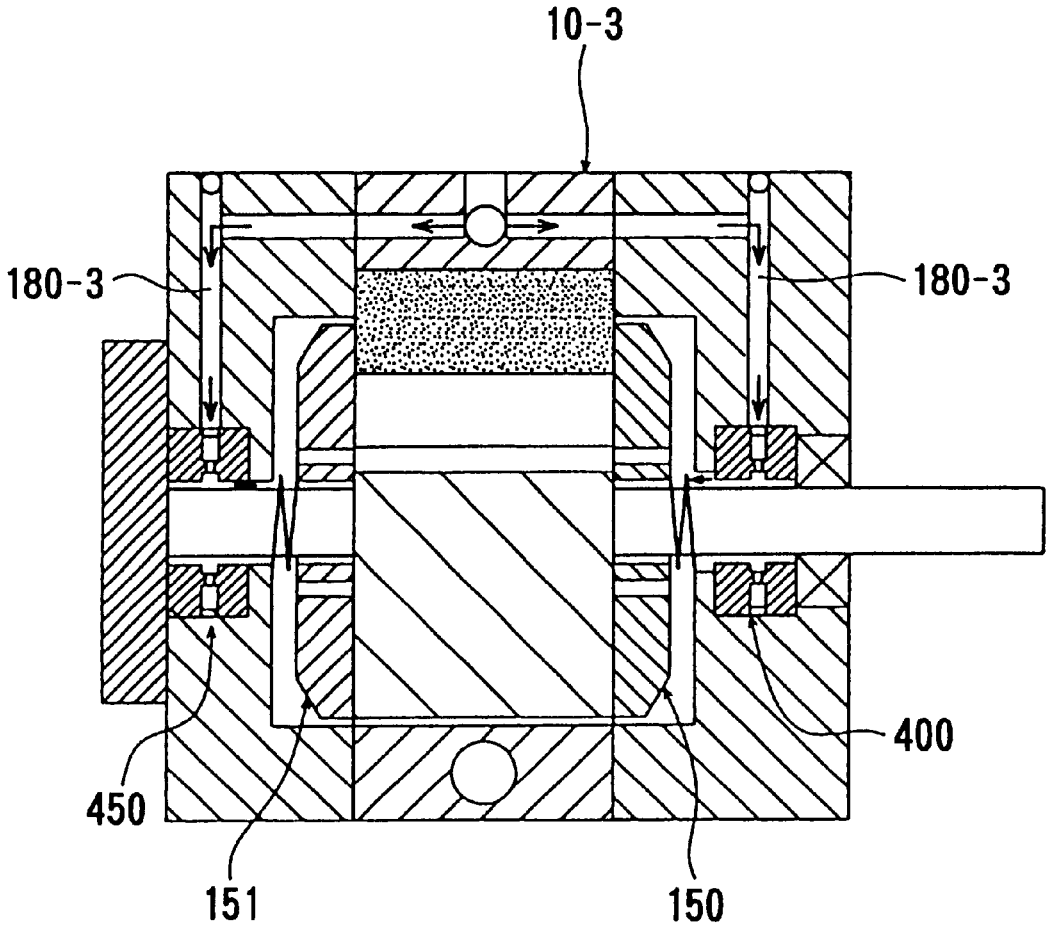
FIG. 8 is a vertical cross-sectional view of a vane pump according to a modification of the third embodiment of the present invention.

FIG. 8 is a vertical cross-sectional view of a vane rotary machine constructed as a vane pump according to a modification of the third embodiment of the present invention. Those parts of the modification which are identical or correspond to those of the third embodiment shown in FIG. 6 are denoted by identical reference numerals.

The vane pump is different from the vane pump shown in FIG. 6 only with respect to the fluid paths 180-3. With the structure of the vane pump shown in FIG. 6, the fluid paths 180-3 are branched to supply a part of the working fluid to the rear surfaces of the pressure side plates 150, 151. In the vane pump shown in FIG. 8, however, the fluid paths 180-3 are connected to only the bearing assemblies 400, 450 so that the working fluid is supplied in its entirety to the bearing assemblies 400, 450, and the working fluid that has passed through the bearing assemblies 400, 450 is supplied to the rear surfaces of the pressure side plates 150, 151. In this structure, therefore, the working fluid that has passed through the bearing assemblies 400, 450 is led to the pressure side plates 150, 151 and used to press the pressure side plates 150, 151. The working fluid can effectively be utilized also in this manner. The present embodiment can also be used as a vane motor.

With the above arrangement, in a vane rotary machine (pump or motor) which uses a low-viscosity fluid such as water as the working fluid, particularly, an unbalanced-type vane rotary machine, the bearing assemblies are prevented from suffering increased mechanical loss, deterioration, and increased generated heat. The advantages of the floating side plate type vane rotary machine are utilized to reduce the flow rate of leakage fluid, and increase the efficiency of the vane rotary machine.

Fourth embodiment

Figure 9:
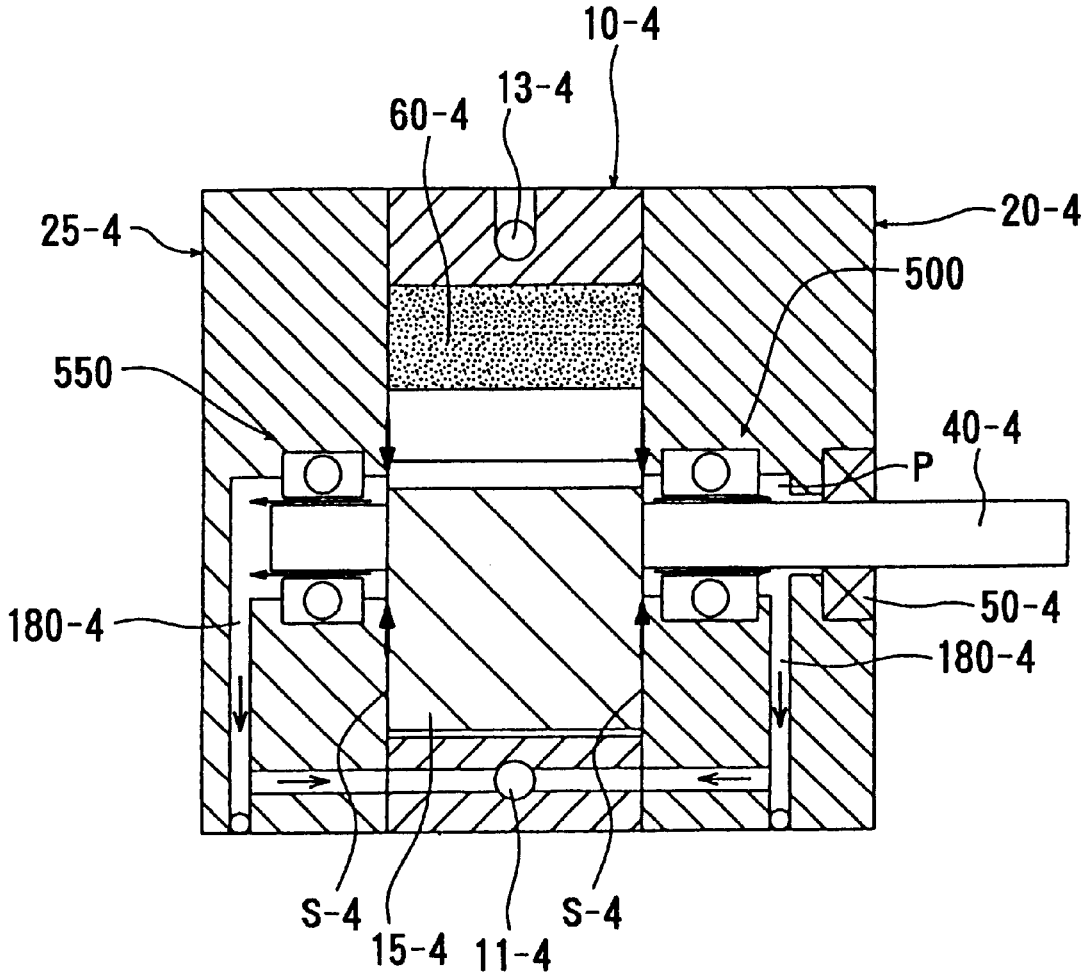
FIG. 9 is a vertical cross-sectional view of a vane pump according to a fourth embodiment of the present invention.

FIG. 9 is a vertical cross-sectional view of a vane rotary machine constructed as a vane pump according to a fourth embodiment of the present invention.

As shown in FIG. 9, the vane pump comprises a rotor 15-4 housed in a cam casing 10-4 and supporting vanes 60-4, a front cover 20-4 and an end cover 25-4 surrounding opposite sides of the rotor 15-4, a main shaft 40-4 attached to the rotor 15-4 and rotatably supported by bearing assemblies 500, 550 mounted in the front cover 20-4 and the end cover 25-4, and a seal (shaft seal) 50-4 mounted on the front cover 20-4. When the rotor 15-4 is rotated, a fluid drawn from a supply port 11-4 into a space between adjacent ones of the vanes 60-4 is pumped and discharged into a discharge port 13-4. The rotor 15-4 is displaceable axially of the main shaft 40-4 in a range of side clearances S-4, S-4 thereof.

In this embodiment, the bearing assemblies 500, 550 comprise rolling bearings (or bearings of any various other structures), and fluid paths 180-4, 180-4 have ends connected to the sides of the bearing assemblies 500, 550 remote from the rotor 15-4 and other ends connected to the supply port 11-4, which is a low-pressure side. These fluid paths 180-4, 180-4 are formed to lead the fluid under pressure from the bearing assemblies 500, 550 on both sides of the rotor 15-4 to the low-pressure supply port 11-4.

The rotor 15-4 is made of ceramics or various engineering plastics such as PEEK or PTFE which are of excellent slidability when lubricated by water. The rotor 15-4 may also be made of any of other materials.

When the vane pump is driven, part of the fluid under pressure passes from the side clearances S-4, S-4 through the left and right bearing assemblies 500, 550, and then passes through the fluid paths 180-4, 180-4 to the supply port 11-4.

With the fluid paths thus arranged, the pressures on the both sides of the rotor 15-4 are substantially equalized to the pressure (≈0) in the supply port 11-4, and hence are held in a state of balance. Therefore, essentially no pressure acts on the rotor 15-4 in the direction along the main shaft 40-4, thus allowing the rotor 15-4 to be balanced in the cam casing 10-4 in the direction along the main shaft 40-4. Any frictional loss due to the sliding motion between the rotor 15-4 and the front and end covers 20-4, 25-4 is reduced to thus prevent the mechanical efficiency and output from being reduced. The flow rate of leakage fluid due to the wear of the rotor 15-4 is prevented from increasing, and the volumetric efficiency and the durability are prevented from being lowered.

Operating conditions of the seal 50-4 are kept in good conditions. Specifically, since the internal seal pressure P is small and the seal 50-4 applies a small pressing force to the main shaft 40-4, no friction-induced mechanical loss is generated in this region. In addition, the seal 50-4 and the main shaft 40-4 do not develop frictional wear and are not reduced in durability.

If the vane rotary machine is used as a vane motor, the port 13-4 operates as a high-pressure supply port, and the port 11-4 operates as a low-pressure return port. In brief, the vane rotary machine may be arranged such that the fluid paths 180-4, 180-4 are connected to a port which is a low-pressure side.

As described in detail with respect to the first through fourth embodiments, the present invention offers the following excellent advantages:

(1) Even if a low-viscosity fluid such as water is used as the working fluid, the bearing assemblies are prevented from being deteriorated and have their increased durability.

(2) If the bearing assemblies comprise sliding bearings and the working fluid passes through the bearing assemblies, then since they does not have any liquid reservoirs unlike the conventional sliding bearings and the working fluid circulates through the device at all times, the crevice corrosion is prevented from occurring, water as the working fluid is prevented from being corroded and degraded, and the heat generated by friction is prevented from increasing.

(3) If the bearings comprise hydrostatic bearings and the fluid paths are provided to branch the working fluid to the bearing assemblies, then since the main shaft and the bearing assemblies operate out of contact with each other, the bearing assemblies are prevented from being deteriorated and the generated heat is prevented from increasing. Inasmuch as the bearings are kept out of contact with the main shaft unlike the sliding bearings, the members of the bearing assemblies may be made of a material that can be selected with ease.

(4) If the branched working fluid is supplied to the bearing assemblies which comprise hydrostatic bearings and also to the pressure side plates, then while the advantages of the floating side plate type vane pump are being utilized to reduce the flow rate of fluid leaking from the side clearances of the rotor, even if a low-viscosity fluid such as water is used as the working fluid, the bearing assemblies are prevented from suffering increased mechanical loss, deterioration, and increased generated heat.

(5) If the fluid paths are provided to lead the fluid under pressure from the bearing assemblies on both sides of the rotor to the low-pressure port, then the rotor is balanced in the cam casing in the direction along the main shaft. Any frictional loss due to the sliding motion between the rotor and the front and end covers is reduced to thus prevent the mechanical efficiency and output from being reduced, and the durability is increased.

Fifth Embodiment

Figure 10A:
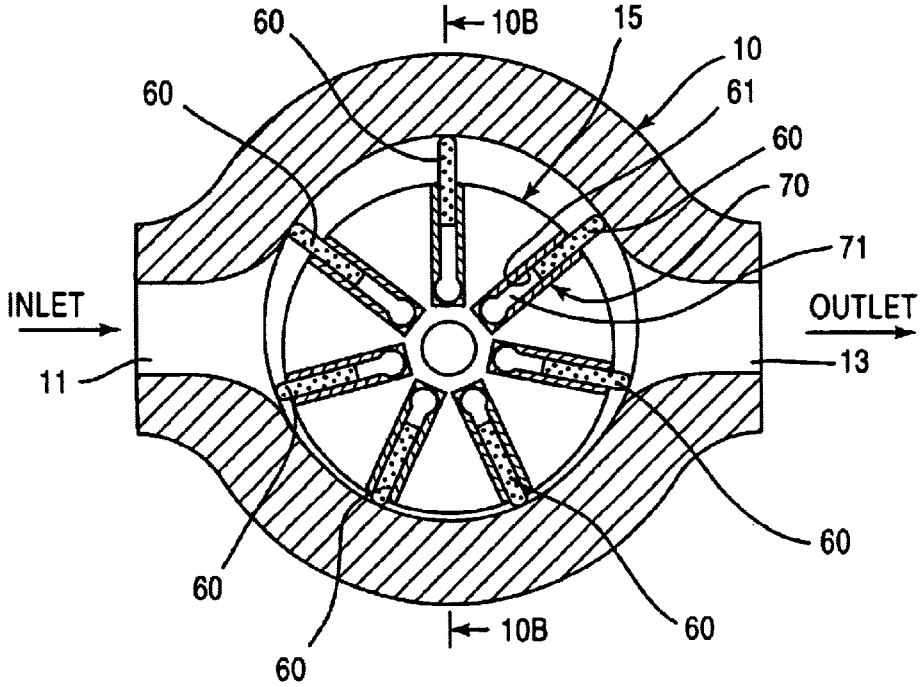
FIGS. 10A and 10B are views showing a vane pump according to a fifth embodiment of the present invention, FIG. 10A being a cross-sectional view taken along line 10A—10A of FIG. 10B, and FIG. 10B being a cross-sectional view taken along line 10B—10B of FIG. 10A.
Figure 10B:
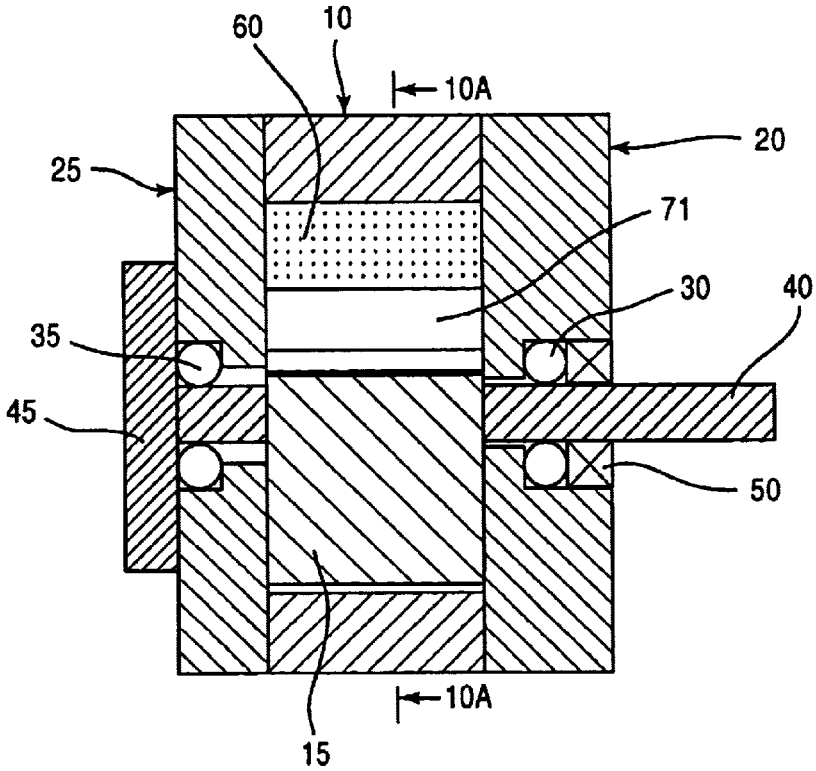

FIGS. 10A and 10B are views showing a vane rotary machine constructed as a vane pump according to a fifth embodiment of the present invention. FIG. 10A is a cross-sectional view taken along line B—B of FIG. 10B, and FIG. 10B is a cross-sectional view taken along line A—A of FIG. 10A. Those parts shown in FIGS. 10A and 10B which are identical or correspond to those shown in FIG. 1 are denoted by identical reference numerals.

As shown win FIGS. 10A and 10B, the vane pump comprises a rotor 15 housed in a cylindrical cam casing 10, a plurality of vanes 60 mounted on the rotor 15 and held in contact with an inner surface of the cam casing 10, a front cover 20 and an end cover 25 surrounding opposite sides of the rotor 15, a main shaft 40 attached to the rotor 15 and rotatably supported by bearings 30, 35 mounted in the front cover 20 and the end cover 25, a rear cap 45 mounted on the end cover 25, and a seal 50 mounted on the front cover 20. When the main shaft 40 is drive to rotate the rotor 15, a working fluid drawn from a supply port 11 defined in the cam casing 10 into a space between adjacent ones of the vanes 60 is pumped and discharged into a discharge port 13.

Figure 11:
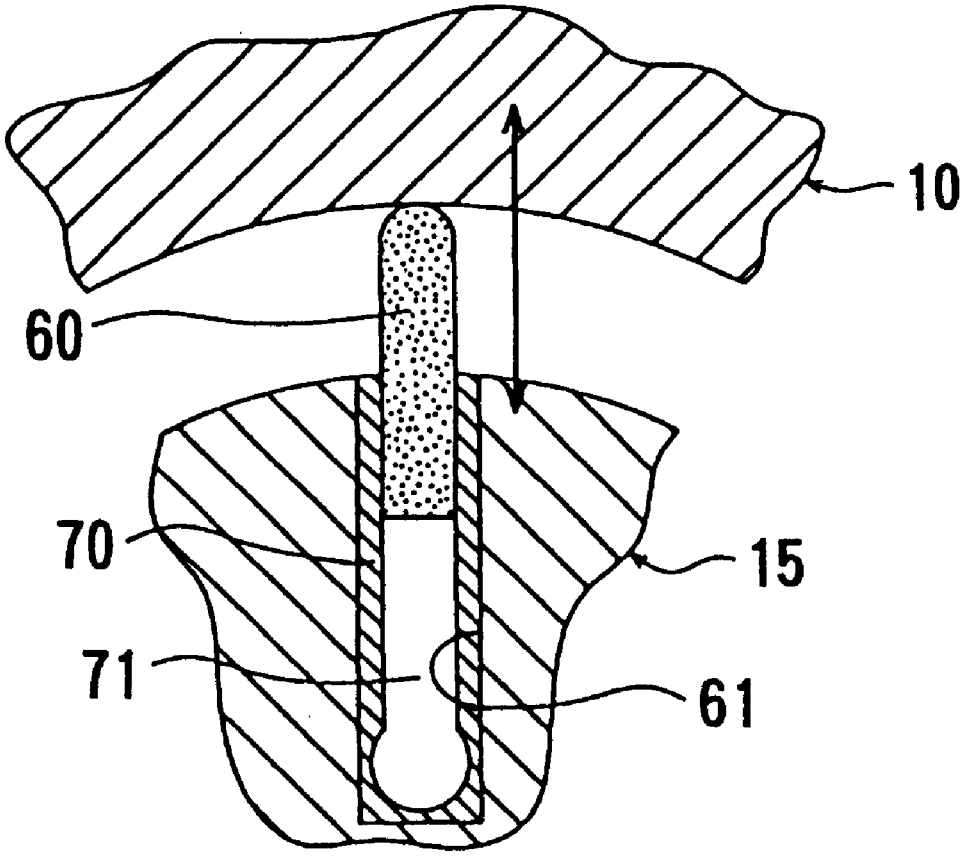
FIG. 11 is an enlarged fragmentary cross-sectional view of a van 60 as shown in FIGS. 10A and 10B.

FIG. 11 is an enlarged fragmentary cross-sectional view of one of the vanes 60. As shown in FIGS. 11 and 10A, 10B, according to the present invention, rotor slit members 70 are press-fitted, shrink-fitted, or bonded in a plurality of fitting grooves 61 defined in the outer circumference of the rotor 15, and the vanes 60 are slidably disposed in rotor slits 71 that are defined in the rotor slit members 70.

The rotor slit members 70 are made of a material of excellent slidability (low-frictional-wear property) when lubricated by water (and a low-viscosity fluid), e.g., a plastic (resin) material such as fluororesin (PTFE) or polyetheretherketone (PEEK), or ceramics.

The vanes 60 are made of a material such as stainless steel. Depending on the properties of the rotor slit members 70, a material of excellent slidability (low-frictional resistance) is selected as the material of the vanes 60.

In the present embodiment, as described above, since the rotor slit members 70 which have the rotor slits 71 with the vanes 60 slidably disposed therein are made of a low-frictional-wear material, even if a low-viscosity fluid such as water is used in the vane pump (or motor), any frictional resistance due to the sliding motion between the vanes 60 and the rotor slit members 71 is reduced, thus preventing the efficiently from being lowered.

With this structure, rotor slits that need to be machined with precision are not required to be directly machined in the rotor 15, but may be provided by machining the separate rotor slit members 70. Therefore, the rotor slits can easily be formed, and the clearances between the rotor slits 70 and the vanes 60 can easily be managed.

While the vane pump shown in FIGS. 10A and 10B are of the unbalanced type, since balanced vane pumps and motors operate in substantially the same manner as the unbalanced type, the present invention is also applicable to those balanced vane pumps and motors, though any specific embodiments thereof will not be described below.

If the present embodiment is constructed as a vane motor, then it is of a structure essentially identical to the above vane pump. However, in the vane pump, the vanes 60 are pressed against the inner surface of the cam casing 10 under centrifugal forces and the pressure of the working fluid. In the vane motor, until the vanes 60 are pushed out under centrifugal forces in a stage where the motor starts rotating, the working fluid passes through from the higher-pressure side to the lower-pressure side. Therefore, the vane motor has springs for pushing the vanes 60 against the inner surface of the cam casing 10 from the start of operation thereof.

Sixth Embodiment

Figure 12:
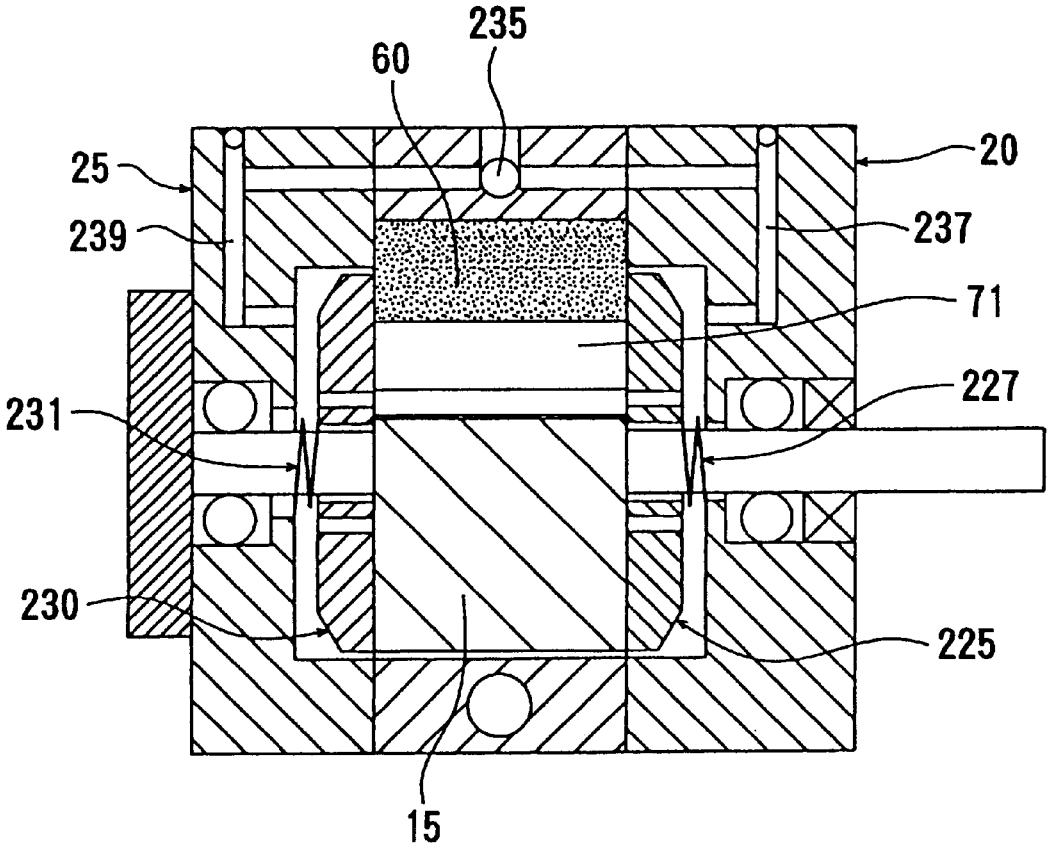
FIG. 12 is a vertical cross-sectional view of a van pump according to a sixth embodiment of the present invention.

FIG. 12 is a vertical cross-sectional view of a vane rotary machine constructed as a vane pump according to a sixth embodiment of the present invention (the view corresponds to FIG. 10B). Those parts shown in FIG. 12 which are identical or correspond to those of the fifth embodiment are denoted by identical reference numerals.

As shown in FIG. 12, in order to reduce the flow rate of fluid leaking from gaps between the side surfaces of the rotor 15 and the front and end covers 20, 25 of the vane pump shown in FIGS. 10A and 10B, the floating side plate type vane pump has pressure side plates 225, 230 disposed respectively between the rotor 15 and the front cover 20 and between the rotor 15 and the end cover 25 and pressed against the both side surfaces of the rotor 15 by resilient means 227, 231, with the pressure of the discharged fluid being applied from the discharge port 235 via fluid paths 237, 239 to the rear surfaces of the pressure side plates 225, 230.

The pressure discharged from the pump is led to the rear surfaces of the pressure side plates 225, 230, and depending on the pressure used at that time, the force by which the pressure side plates 225, 230 are pressed against the side surfaces of the rotor 15 is changed to adjust the gaps (rotor side clearances) while the rotor 15 is in sliding rotation.

Figures 13A, 13B, 13C:
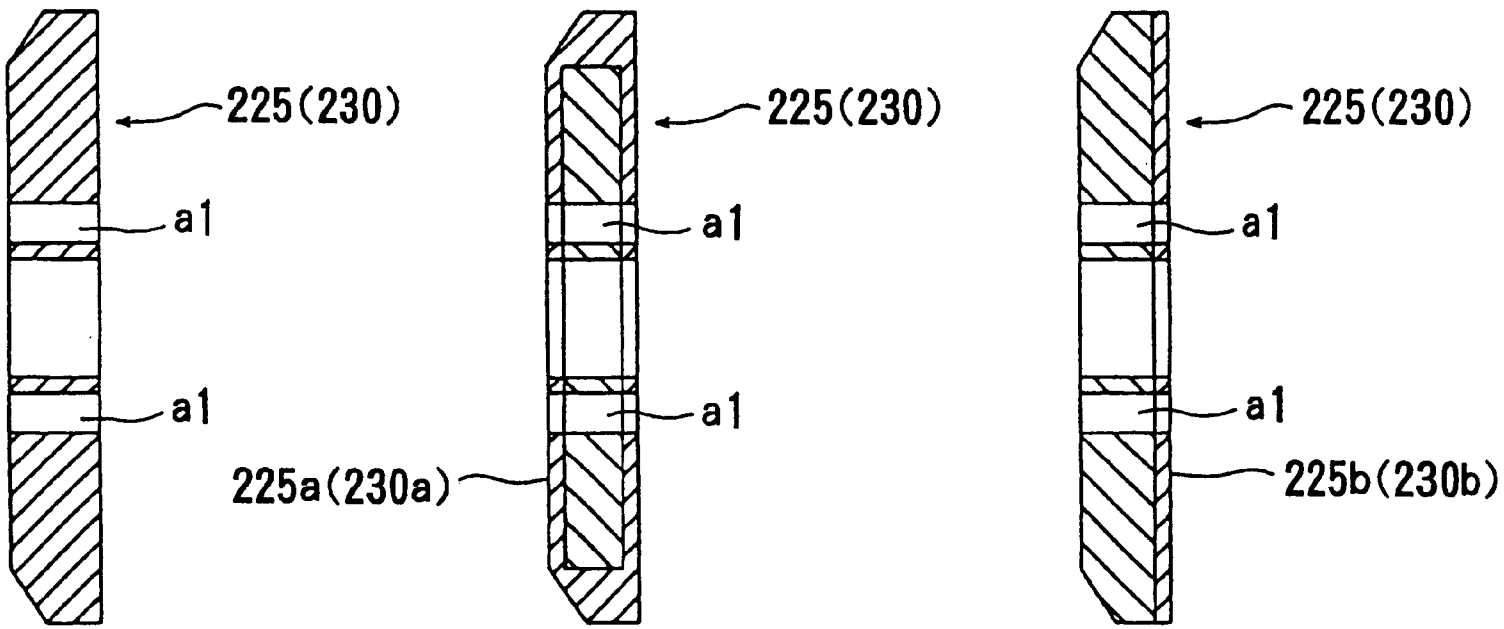
FIGS. 13A. 13B, and 13C are vertical cross-sectional views of a pressure side plate 225 (230) as shown in FIG. 23.

FIGS. 13A, 13B, and 13C are vertical cross-sectional views of the pressure side plate 225 (230) used in the present embodiment. As shown in FIG. 13A, the pressure side plate 225 (230) is made, in its entirety, of a low-frictional-wear material of excellent slidability (low-frictional-wear property) when lubricated by water (and a low-viscosity fluid), e.g., a plastic (resin) material such as fluororesin (PTFE) or polyetheretherketone (PEEK), or ceramics.

As shown in FIG. 13B, the pressure side plate 225 (230) comprises a member of stainless steel or the like which is coated, on its entire surface, with a coating layer 225*a* (230*a*) that is made of a low-frictional-wear material of excellent slidability (low-frictional-wear property) when lubricated by water (and a low-viscosity fluid), e.g., a plastic (resin) material such as fluororesin (PTFE) or polyetheretherketone (PEEK), or ceramics, titanium nitride (TiN), diamond-like carbon (DLC), or the like.

As shown in FIG. 13C, the pressure side plate 225 (230) is made of steel or the like and has a surface for sliding contact with the rotor 15, which is coated with a coating layer 225*b* (230*b*) made of the above low-frictional-wear material.

With the above arrangement, the slidability is increased, and wear and mechanical loss due to the friction between the pressure side plates 225, 230 and the rotor 15 can be reduced. In FIGS. 13A, 13B, and 13C, al denotes holes for supplying the liquid pressure to the rotor slits 71 to push the vanes 60 outwardly.

In case of the motor, the supplied pressure of the working fluid, rather than the discharged pressure thereof, is led to the rear surfaces of the pressure side plates 225, 230. In this embodiment, the pressure side plates 225, 230 are disposed respectively on the both sides of the rotor 15. Depending on the structure of the vane rotary machine, a pressure side plate may be disposed on only one side of the rotor 15.

Seventh Embodiment

Figure 14A:
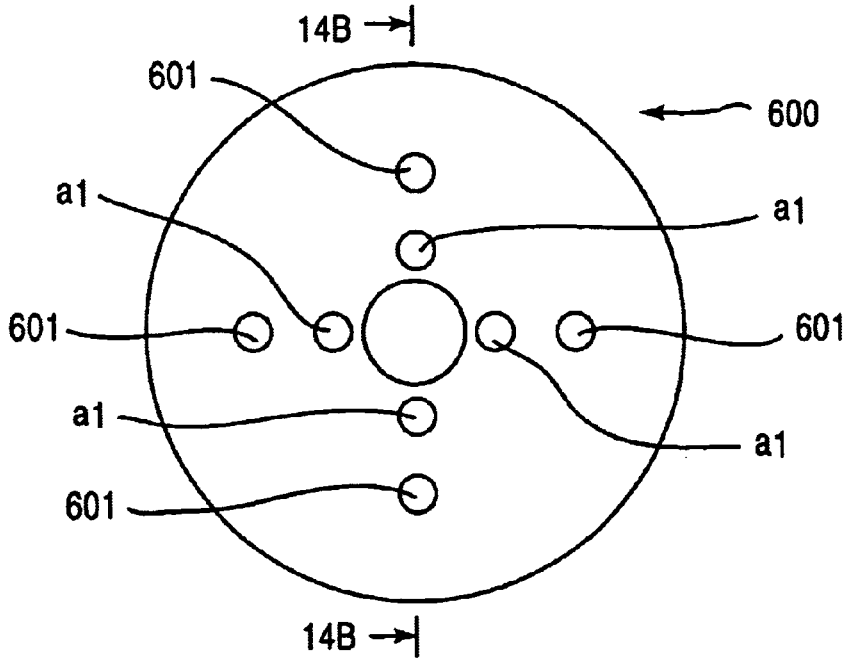
FIGS. 14A and 14B are views showing a pressure side plate 600 used n a seventh embodiment of the present invention, FIG. 14A being a plan view, and FIG. 14B being a cross-sectional view taken along line 14B—14B of FIG. 14A.
Figure 14B:
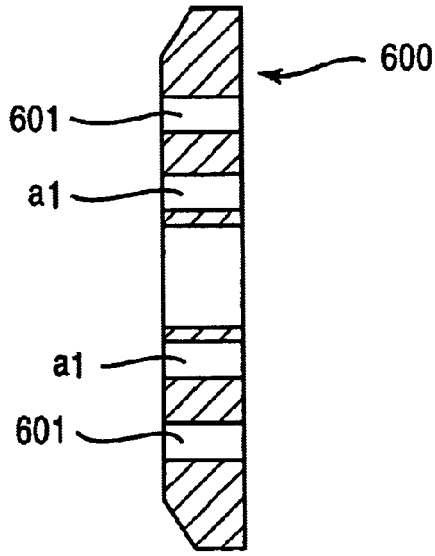
Figure 15A:
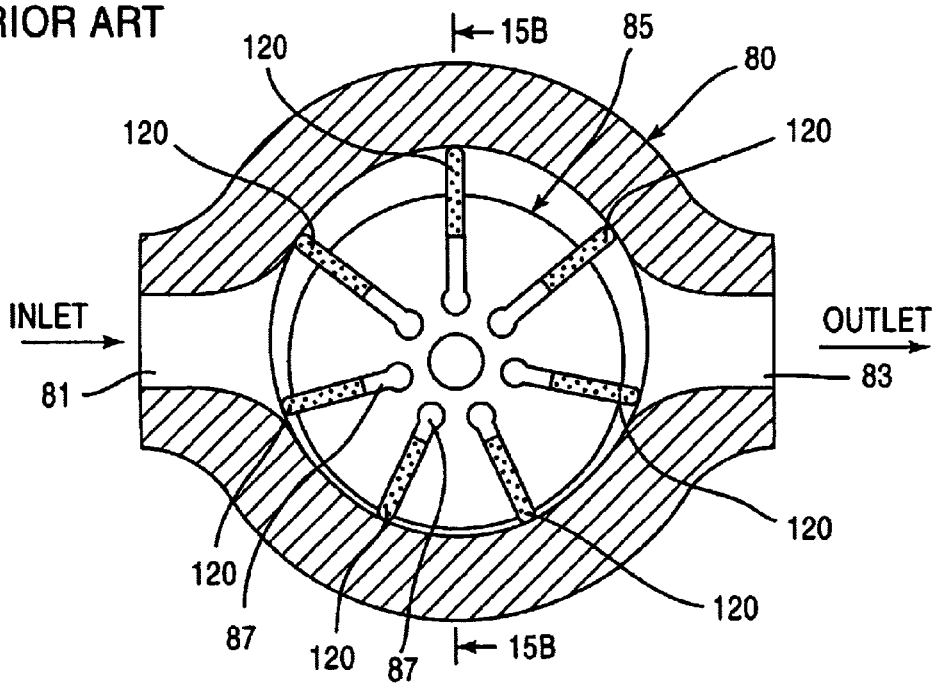
FIG. 15A PRIOR ART
FIGS. 15A and 15B views showing an example of a structure of a conventional typical vane pump, FIG. 15A being a cross-sectional view taken along line 15A—15A of FIG. 15B, and FIG. 15B being a cross-sectional view taken along line 15A—15A.
Figure 15B:
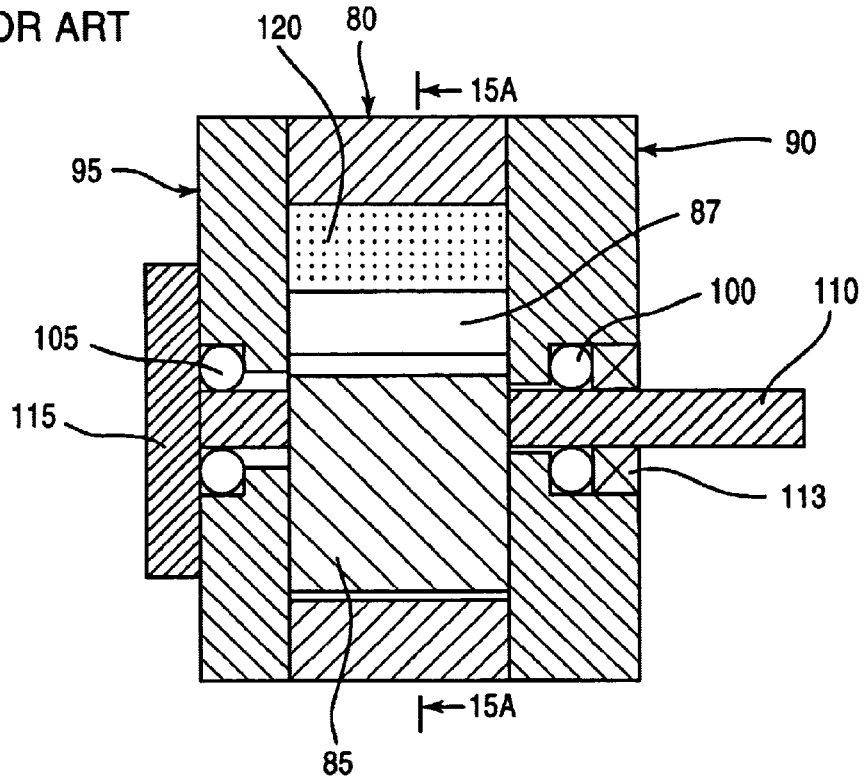
FIG. 15B PRIOR ART
Figure 16:
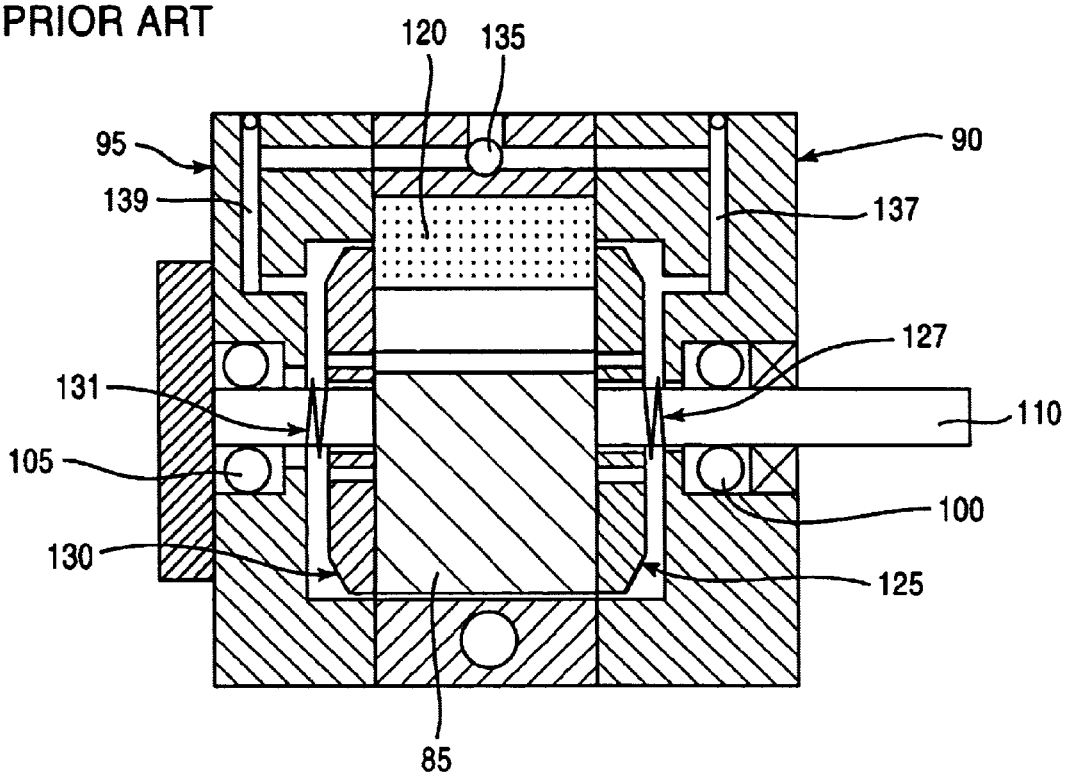
FIG. 16 PRIOR ART
FIG. 16 is a vertical cross-sectional view showing an example of a structure of a conventional typical floating side plate type vane pump.

FIGS. 14A and 14B are views showing a pressure side plate 600 for use in the present embodiment. FIG. 14A is a plan view, and FIG. 14B is a vertical cross-sectional view taken along line C—C of FIG. 14A. The pressure side plate 600 shown in FIGS. 14A and 14B can be used in place of the pressure side plates 225, 230 shown in FIG. 12. The pressure side plate 600 has four fluid paths 601 defined therein as through holes for forming a water film between the pressure side plate 600 and the rotor 15. In FIGS. 14A and 14B, al denotes holes for supplying the liquid pressure to the rotor slits.

With the pressure side plate 600 used, it is possible to introduce the working fluid from the discharge port 235 shown in FIG. 12 via the fluid paths 601 into the gap between the pressure side plate 600 and the rotor 15 for thereby forming a water film easily therebetween to increase a lubricating capability between the pressure side plate 600 and the rotor 15. The number and positions of the fluid paths 601 are not limited to the illustrated details, but may be varied in various manners.

If the pressure side plate 600 is made of the low-frictional-wear material as shown in FIGS. 13A through 13C, then the advantages offered by the fluid paths 601 and the low-frictional-wear material are available for further increasing the slidability.

If the fifth embodiment and the sixth and seventh embodiments are simultaneously applied to the same vane rotary machine, then the efficiency can further be increased effectively by the reduction in the frictional resistance.

If the rotor slit members and the pressure side plates are made of the low-frictional-wear material such as ceramics or plastic material, then the corrosion resistance thereof for use in water can be increased.

As described in detail with respect to the fifth through seventh embodiments, the present invention offers the following excellent advantages:

(1) Inasmuch as the rotor slit members and the pressure side plates are made of the low-frictional-wear material and the pressure side plates have fluid paths for forming a water film between the pressure side plates and the rotor, even if a low-viscosity fluid such as water is used as the working fluid, the mechanical efficiency and durability are not impaired, but can be increased.

(2) Since the rotor slit members made of the low-friction-wear material and having the rotor slits for holding the vanes slidably therein are mounted on the rotor, the rotor slits can be machined easily with increased accuracy, and the clearances between the rotor slits and the vanes can be managed with ease.

Industrial Applicability

The present invention is applicable to a vane rotary machine such as a vane pump or a vane motor, and can particularly be used preferably as a vane rotary machine which uses a low-viscosity fluid such as water as a working fluid.

We claim:

1. A vane rotary machine having a rotor supporting vanes thereon and housed in a cam casing, and a main shaft attached to said rotor and rotatably supported by bearing assemblies, characterized in that fluid paths are provided to connect a discharge port of said vane rotary machine to a supply port of said vane rotary machine for thereby leading a working fluid from a high-pressure side of said vane rotary machine via both side clearances of said rotor and thereafter through said bearing assemblies located at both sides of said rotor to said supply port of said vane rotary machine so that pressures of both sides of said rotor become a pressure of said supply port to equalize pressures on both sides of said rotor.

2. A vane rotary machine according to claim 1, wherein said working fluid comprises water.

* * * * *